US005866308A

United States Patent [19]

Göhmann et al.

[11] Patent Number: 5,866,308

[45] Date of Patent: Feb. 2, 1999

[54] PRODUCTION OF A COLOR PHOTOGRAPHIC IMAGE

[75] Inventors: Jürgen Göhmann, Monheim; Norman Klaunzer, Leverkusen; Arno Schmuck, Leichlingen, all of Germany

[73] Assignee: Agfa-Gevaert AG, Germany

[21] Appl. No.: 940,714

[22] Filed: Sep. 30, 1997

[30] Foreign Application Priority Data

Oct. 18, 1996 [DE] Germany ..... 196 43 032.1

[51] Int. Cl.[6] ..... G03C 7/42

[52] U.S. Cl. ..... 430/393; 430/430; 430/943

[58] Field of Search ..... 430/357, 393, 430/430, 455, 461, 943

[56] References Cited

U.S. PATENT DOCUMENTS 5,670,300 9/1997 Fyson et al. ..... 430/430

*Primary Examiner*—Hoa Van Le
*Attorney, Agent, or Firm*—Connolly & Hutz

[57] ABSTRACT

In the production of a colour photographic image in a continuous process comprising at least the stages a) treatment with a bath containing $H_2O_2$ or a bath containing a compound which liberates $H_2O_2$ and b) fixing, wherein stage b) immediately follows stage a), precipitation of silver oxide and silver is avoided if the fixing bath contains an anti-oxidant and a buffer substance in addition to the fixing agent, a molar ratio of anti-oxidant to fixing agent of >0.2 is maintained and the quantity of buffer substance is >0.4 mol/l.

8 Claims, No Drawings

PRODUCTION OF A COLOR PHOTOGRAPHIC IMAGE

This invention relates to the production of a colour photographic image in a continuous process comprising at least the stages a) treatment with a bath containing $H_2O_2$ or a bath containing a compound which liberates $H_2O_2$ and b) fixing, wherein stage b) immediately follows stage a).

When a process in which a conventional fixing bath immediately follows an intensifying bath or bleaching bath containing $H_2O_2$ is performed continuously, silver oxide and silver precipitation occurs after a short time, which is deposited on the transport rollers and then soils the photographic material.

The object of the invention is to avoid this disadvantage.

It has now been found that this disadvantage may be avoided if, during the continuous process, a molar ratio of anti-oxidant to fixing agent of >0.2 is maintained and the fixing bath contains a buffer substance in a quantity of >0.4 mol/l.

Preferred embodiments of the invention are when the molar ratio of antioxidant to fixing agent is >0.25 and the buffer substance is present in a quantity of >0.6 mol/l.

Suitable anti-oxidants are sulphites and sulphinates.

Suitable fixing agents are thiosulphates, halides and thiocyanates, with alkali metal and ammonium thiosulphates being preferred.

The buffer substances should in particular buffer a pH value range from 5 to 9.

Preferred buffer substances are mono- and polycarboxylic acids, carbonates, phosphonates and phosphates.

The process according to the invention is suitable for all conventional colour photographic materials, but may be used particularly advantageously with low-silver materials having a silver halide application rate of $\geqq 0.50$ g/m$^2$ (as Ag) and an AgCl content of the emulsion of greater than 95 mol. %.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides thereof is given in Research Disclosure 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally arranged between the green-sensitive and blue-sensitive layers to prevent blue light from reaching the underlying layers.

Possible options for different layer arrangements and the effects thereof on photographic properties are described in J. Inf. Rec. Mats., 1994, volume 22, pages 183–193.

Colour photographic paper, which is usually substantially less photosensitive than a colour photographic film, conventionally has on the support, in the sequence stated below, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together another package of layers in order to increase sensitivity (DE 25 30 645).

The substantial constituents of the photographic emulsion layers are binder, silver halide grains and colour couplers.

Details of suitable binders may be found in Research Disclosure 37254, part 2 (1995), page 286.

Details of suitable silver halide emulsions, the production, ripening, stabilisation and spectral sensitisation thereof, including suitable spectral sensitisers, may be found in Research Disclosure 37254, part 3 (1995), page 286 and in Research Disclosure 37038, part XV (1995), page 89.

Photographic materials with camera sensitivity conventionally contain silver bromide-iodide emulsions, which may optionally also contain small proportions of silver chloride. Photographic print materials contain either silver chloride-bromide emulsions with up to 80 wt. % of AgBr or silver chloride-bromide emulsions with above 95 mol. % of AgCl.

Details relating to colour couplers may be found in Research Disclosure 37254, part 4 (1995), page 288 and in Research Disclosure 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in Research Disclosure 37254, part 5 (1995), page 290 and in Research Disclosure 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in Research Disclosure 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in Research Disclosure 37254, part 7 (1995), page 292 and in Research Disclosure 37038, part III (1995), page 84.

The photographic material may also contain UV light absorbing compounds, optical whiteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in Research Disclosure 37254, part 8 (1995), page 292 and in Research Disclosure 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294 and in Research Disclosure 37038, part XII (1995), page 86.

Once exposed with an image, colour photographic materials are processed using different processes depending upon their nature. Details relating to processing methods and the necessary chemicals are disclosed in Research Disclosure 37254, part 10 (1995), page 294 and in Research Disclosure 37038, parts XVI to XXIII (1995), pages 95 et seq. together with example materials.

According to the invention, however, the material is passed through a fixing bath, which immediately follows a bath which contains $H_2O_2$ or an $H_2O_2$-liberating compound.

EXAMPLE 1

A colour photographic recording material, which contained the following layers applied in the stated sequence onto a paper coated on both sides with polyethylene, wherein all quantities are stated per 1 $m^2$ and the quantities of silver are stated as $AgNO_3$, was exposed with an image and processed as stated.

1st layer (substrate layer)

0.10 g of gelatine

2nd layer (blue-sensitive layer)

Blue-sensitive silver halide emulsion (99.5 mol. % of chloride and 0.5 mol. % of bromide, average grain diameter 0.9 $\mu$m) prepared from 0.50 g of $AgNO_3$ and 1.25 g of gelatine 0.42 g of yellow coupler Y-1

0.18 g of yellow coupler Y-2

0.50 g of tricresyl phosphate (TCP)

0.10 g of stabiliser ST-1

0.70 mg of blue sensitiser S-1

0.30 mg of stabiliser ST-2

3rd layer (interlayer)

1.10 g of gelatine 0.06 g of oxform scavenger O-1

0.06 g of oxform scavenger O-2

0.12 g of TCP

4th layer (green-sensitive layer)

Green-sensitised silver halide emulsion (99.5 mol. % of chloride, 0.5 mol. % of bromide, average grain diameter 0.47 $\mu$m) prepared from 0.40 g of $AgNO_3$ and 0.77 g of gelatine 0.41 g of magenta coupler M-1

0.06 g of stabiliser ST-3

0.12 g of oxform scavenger O-2

0.34 g of dibutyl phthalate (DBP)

0.70 mg of green sensitiser S-2

0.50 mg of stabiliser ST-4

5th layer (UV protective layer)

1.15 g of gelatine 0.50 g of UV absorber UV-1

0.10 g of UV absorber UV-2

0.03 g of oxform scavenger O-1

0.03 g of oxform scavenger O-2

0.35 g of TCP

6th layer (red-sensitive layer)

Red-sensitised silver halide emulsion (99.5 mol. % of chloride, 0.5 mol. % of bromide, average grain diameter 0.5 $\mu$m) prepared from 0.30 g of $AgNO_3$ and 1.00 g of gelatine 0.46 g of cyan coupler C-1

0.46 g of TCP 0.03 mg of red sensitiser S-3

0.60 mg of stabiliser ST-5

7th layer (UV protective layer)

0.35 g of gelatine 0.15 g of UV absorber UV-1

0.03 g of UV absorber UV-2

0.09 g of TCP

8th layer (protective layer)

0.90 g of gelatine 0.05 g of optical whitener W-1

0.07 g of polyvinylpyrrolidone 1.20 mg of silicone oil 2.50 mg of spacer (polymethyl methacrylate)

0.30 g of hardener H-1

Y-1
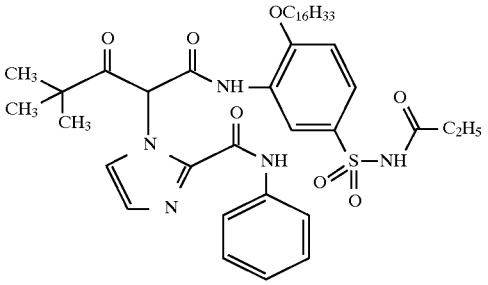
Y-2
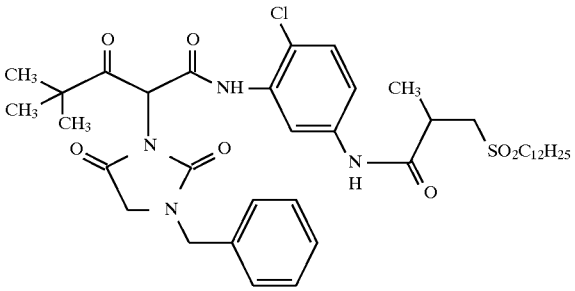
M-1
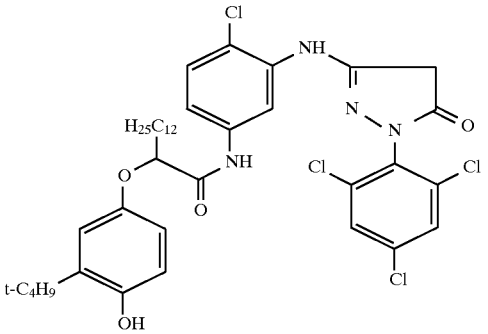
C-1
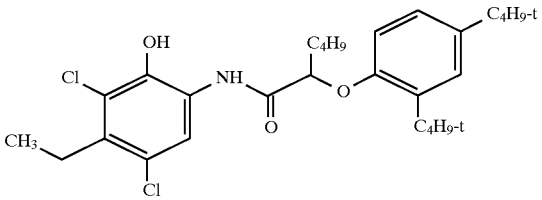
S-1
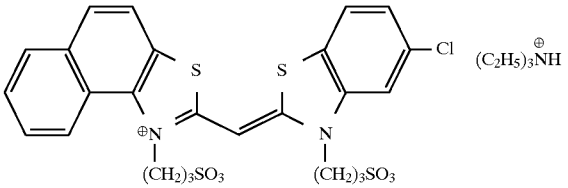
S-2
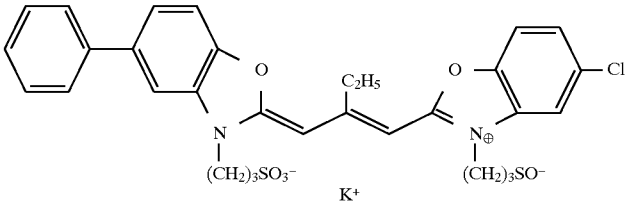

-continued
S-3
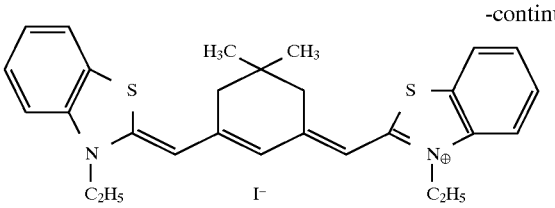
ST-1
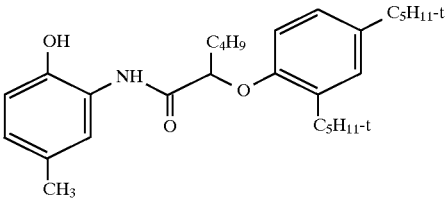
ST-2
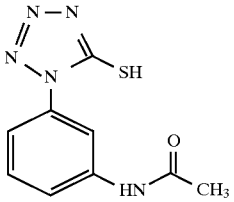
ST-3
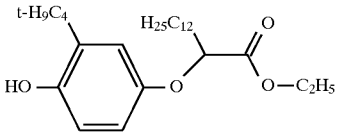
ST-4
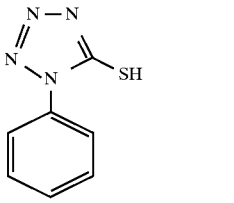
ST-5
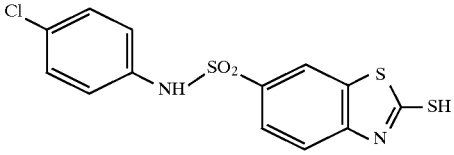
O-1
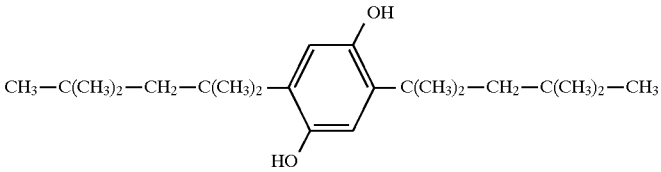
O-2
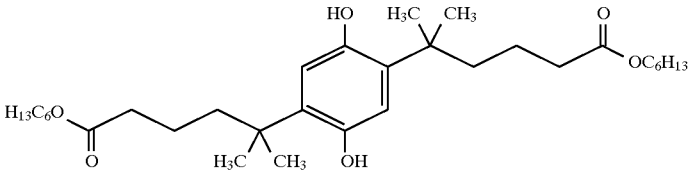
UV-1
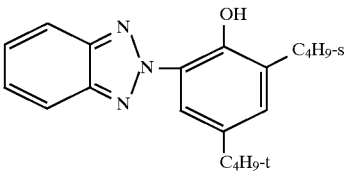

-continued

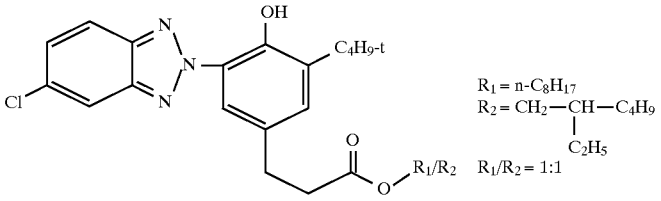

UV-2

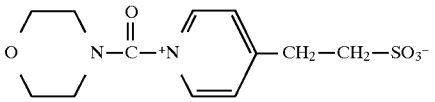

H-1

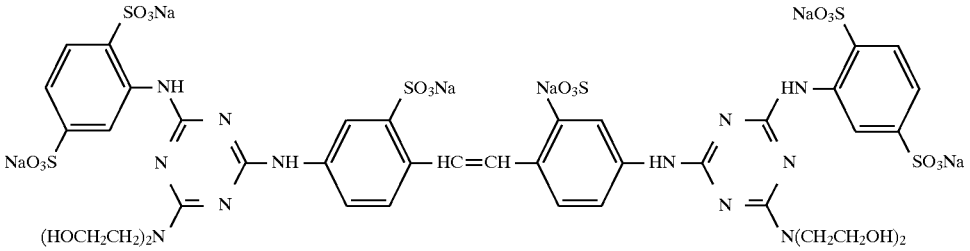

W-1

| Bath | Temperature | Time | Replenishment rate |
|---|---|---|---|
| Development | 35° C. | 45 s | 60 ml/$m^2$ |
| Rinsing | 35° C. | 120 s | 200 ml/$m^2$ |
| Bleaching | 35° C. | 45 s | 250 ml/$m^2$ |
| Fixing | 35° C. | 30 s | 60 ml/$m^2$ |
| Stabilisation | 35° C. | 60 s | 120 ml/$m^2$ |

| Developer | |
|---|---|
| Water | 800 ml |
| CD-3 | 4.5 g |
| Potassium carbonate | 27.0 g |
| Diethylhydroxylamine (85 wt. %, aqueous) | 4 ml |
| Diethylentriamine pentaacetate (40 wt. %, aqueous) | 7 ml |
| Hydroxyethanediphosphonic acid (50 wt. %, aqueous) | 0.2 ml |
| KCl | 3.2 g |
| Optical brightener W-1 | 0.8 g |
| Adjust pH to with KOH, make up to 1 l with water. | 10.5 |

CD-3 is of the formula:

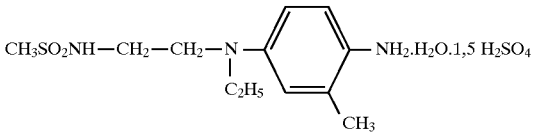

| Bleaching bath | |
|---|---|
| Water | 800 ml |
| Diethylenetriamine pentaacetate (40 wt. %, aqueous) | 2 ml |
| Hydroxyethanediphosphonic acid (60 wt. %, aqueous) | 0.05 ml |
| Sodium dihydrogen phosphate | 4.7 g |

-continued

| | |
|---|---|
| NaCl | 1.5 g |
| $H_2O_2$ (35 wt. %) | 50 ml |
| Adjust pH to with KOH, make up to 1 l with water. | 9.2 |
| Fixing bath | |
| Water | 800 ml |
| Ammonium thiosulphate | 1.0 mol |
| Anti-oxidant | c.f. Table 1 |
| Buffer substance | c.f. Table 1 |
| Ethylenediamine tetraacetate | 1.5 g |
| Adjust pH to with KOH, make up to 1 l with water. | 7.5 |
| Stabilising bath | |
| Water | 800 ml |
| Hydroxyethanediphosphonic acid (60 wt. %, aqueous) | 0.2 ml |
| Sodium benzoate | 0.6 g |
| Acetic acid | 15 ml |
| Ethylendiamine tetraacetate | 1.5 g |
| Adjust pH to with KOH, make up to 1 l with water. | 5.0 |

All the fixing baths fix completely and exhibit no influence upon the photographic result.

TABLE 1

(Resistance of the fixing bath to precipitation)

| Anti-oxidant (substance) mol/l | Molar ratio of fixing agent to anti-oxidant | Buffer (substance) mol/l | Precipitation | Status |
|---|---|---|---|---|
| (1) 0.1 | 10 | (3) 0.4 | severe | Comparison |
| (1) 0.2 | 5 | (3) 0.4 | severe | Comparison |
| (1) 0.4 | 2.5 | (3) 0.4 | none | Invention |
| (1) 0.4 | 2.5 | (3) 0.2 | moderate | Comparison |
| (1) 0.1 | 10 | (4) 0.4 | severe | Comparison |
| (1) 0.2 | 5 | (4) 0.4 | severe | Comparison |
| (1) 0.4 | 2.5 | (4) 0.4 | none | Invention |
| (1) 0.4 | 2.5 | (4) 0.2 | moderate | Comparison |
| (2) 0.1 | 10 | (3) 0.4 | severe | Comparison |
| (2) 0.2 | 5 | (3) 0.4 | severe | Comparison |

TABLE 1-continued (Resistance of the fixing bath to precipitation)

| Anti-oxidant (substance) mol/l | Molar ratio of fixing agent to anti-oxidant | Buffer (substance) mol/l | Precipitation | Status |
|---|---|---|---|---|
| (2) 0.4 | 2.5 | (3) 0.4 | none | Invention |
| (2) 0.4 | 2.5 | (3) 0.2 | moderate | Comparison |

Substance 1 = Natrium sulphite
Substance 2 = Methanesulphinic acid
Substance 3 = Sodium hydrogen carbonate
Substance 4 = Sodium acetate

EXAMPLE 2

A low-silver material was produced which differed from the material according to Example 1 by changed quantities of silver:

2nd layer: 0.25 g of $AgNO_3$
4th layer: 0.20 g of $AgNO_3$
6th layer: 0.15 g of $AgNO_3$
All other layers are identical to Example 1.

| Bath | Temperature | Time | Replenishment rate |
|---|---|---|---|
| Development | 35° C. | 45 s | 60 ml/m$^2$ |
| Intensification/bleaching | 35° C. | 45 s | 400 ml/m$^2$ |
| Fixing | 35° C. | 30 s | 60 ml/m$^2$ |
| Stabilisation | 35° C. | 60 s | 120 ml/m$^2$ |

| Developer | |
|---|---|
| Water | 800 ml |
| CD-3 | 6.0 g |
| Developer E-1 | 1.0 g |
| Potassium carbonate | 22.0 g |
| Diethylhydroxylamine (85 wt. %, aqueous) | 4 ml |
| Diethylenetriamine pentaacetate (40 wt. %, aqueous) | 7 ml |
| Hydroxyethanediphosphonic acid (60 wt. %, aqueous) | 0.2 ml |
| KCl | 3.2 g |
| Optical brightener W-1 | 0.8 g |
| Adjust pH to with KOH, make up to 1 l with water. | 10.5 |

Intensification/bleaching bath

Composition as bleaching bath of Example 1.

| Fixing bath | |
|---|---|
| Water | 800 ml |
| Ammonium thiosulphate | 0.4 mol |
| Anti-oxidant | c.f. Table 2 |
| Buffer substance | c.f. Table 2 |
| Ethylenediamine tetraacetate | 1.5 g |
| Adjust pH to with KOH, make up to 1 l with water. | 7.5 |

Stabilising bath

Composition as stabilising bath from Example 1.

All fixing baths fix completely and exhibit no influence on the photographic result.

TABLE 2

(Resistance of the fixing bath to precipitation)

| Anti-oxidant (substance) | Molar ratio of fixing agent to anti-oxidant | Buffer (substance) mol/l | Precipitation | Status |
|---|---|---|---|---|
| (1) 0.04 | 10 | (3) 0.4 | severe | Comparison |
| (1) 0.08 | 5 | (3) 0.4 | severe | Comparison |
| (1) 0.16 | 2.5 | (3) 0.4 | none | Invention |
| (1) 0.16 | 2.5 | (3) 0.2 | moderate | Comparison |
| (1) 0.04 | 10 | (4) 0.4 | severe | Comparison |
| (1) 0.08 | 5 | (4) 0.4 | severe | Comparison |
| (1) 0.16 | 2.5 | (4) 0.4 | none | Invention |
| (1) 0.16 | 2.5 | (4) 0.2 | moderate | Comparison |
| (2) 0.04 | 10 | (3) 0.4 | severe | Comparison |
| (2) 0.08 | 5 | (3) 0.4 | severe | Comparison |
| (2) 0.16 | 2.5 | (3) 0.4 | none | Invention |
| (2) 0.16 | 2.5 | (3) 0.2 | moderate | Comparison |

Developer E-1 is of the formula:

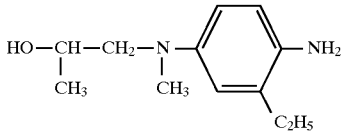

EXAMPLE 3

A colour photographic material according to Example 1 is processed as follows:

| Bath | Temperature | Time | Replenishment rate |
|---|---|---|---|
| Development | 35° C. | 3 min 15 s | 640 ml/m$^2$ |
| Rinsing | 35° C. | 120 s | 1000 ml/m$^2$ |
| Bleaching | 35° C. | 5 min | 400 ml/m$^2$ |
| Fixing | 35° C. | 90 s | 300 ml/m$^2$ |
| Rinsing | 35° C. | 120 s | 2000 ml/m$^2$ |

| Developer | |
|---|---|
| Water | 800 ml |
| CD-4 | 4.2 g |
| Potassium carbonate | 21.0 g |
| Hydroxylamine | 3.6 g |
| Diethylentriamine pentaacetate (40 wt. %, aqueous) | 8 ml |
| Hydroxyethanediphosphonic acid (60 wt. %, aqueous) | 0.2 ml |
| Sodium sulphite | 3.2 g |
| KBr | 3.6 g |
| Adjust pH to with KOH, make up to 1 l with water. | 10.1 |

Bleaching bath

| | |
|---|---|
| Water | 800 ml |
| Diethylentriamine pentaacetate (40 wt. %, aqueous) | 2 ml |
| Hydroxyethanediphosphonic acid (60 wt. %, aqueous) | 0.05 ml |
| Sodium dihydrogen phosphate | 4.7 g (30 mmol) |
| NaCl | 1.5 g |
| $H_2O_2$ (35 wt. %) | 50 ml |
| Adjust pH to with KOH, make up to 1 l with water. | 9.2 |

-continued

| Fixing bath | |
|---|---|
| Water | 800 ml |
| Ammonium thiosulphate | 0.5 mol |
| Ammonium thiocyanate | 0.5 mol |
| Anti-oxidant | c.f. Table 3 |
| Buffer substance | c.f. Table 3 |
| Ethylenediamine tetraacetate | 1.5 g |
| Adjust pH to | 7.5 |
| with KOH, make up to 1 l with water. | |

All the fixing baths fix completely and exhibit no influence on the photographic result.

TABLE 3

(Resistance of the fixing bath to precipitation)

| Anti-oxidant (substance) mol/l | Molar ratio of fixing agent to anti-oxidant | Buffer (substance) mol/l | Precipitation | Status |
|---|---|---|---|---|
| (1) 0.1 | 10 | (3) 0.4 | severe | Comparison |
| (1) 0.2 | 5 | (3) 0.4 | severe | Comparison |
| (1) 0.4 | 2.5 | (3) 0.4 | none | Invention |
| (1) 0.4 | 2.5 | (3) 0.2 | moderate | Comparison |
| (1) 0.1 | 10 | (4) 0.4 | severe | Comparison |
| (1) 0.2 | 5 | (4) 0.4 | severe | Comparison |
| (1) 0.4 | 2.5 | (4) 0.4 | none | Invention |
| (1) 0.4 | 2.5 | (4) 0.2 | moderate | Comparison |
| (2) 0.1 | 10 | (3) 0.4 | severe | Comparison |
| (2) 0.2 | 5 | (3) 0.4 | severe | Comparison |
| (2) 0.4 | 2.5 | (3) 0.4 | none | Invention |
| (2) 0.4 | 2.5 | (3) 0.2 | moderate | Comparison |

EXAMPLE 4

A colour photographic material according to Example 1 is processed as follows:

| Bath | Temperature | Time | Replenishment rate |
|---|---|---|---|
| Development | 35° C. | 3 min 15 s | 640 ml/m$^2$ |
| Rinsing | 35° C. | 120 s | 1000 ml/m$^2$ |
| Bleaching | 35° C. | 4 min 20 s | 250 ml/m$^2$ |
| Fixing | 35° C. | 320 s | 100 ml/m$^2$ |
| Rinsing | 35° C. | 320 s | 2000 ml/m$^2$ |

Developer

Composition as developer from Example 3.

| Bleaching bath | |
|---|---|
| Water | 800 ml |
| β-alaninediacetic acid | 10 g |
| Citric acid | 14 g |
| Iron nitrate | 8.7 g |
| Acetic acid | 60 ml |
| NaCl | 21 g |
| Potassium peroxydisulphate | 30.7 g |
| Adjust pH to | 3.8 |
| with KOH, make up to 1 l with water. | |

-continued

| Fixing bath | |
|---|---|
| Ammonium thiosulphate | 74.1 g |
| Ammonium thiocyanate | 37.5 g |
| Anti-oxidant | c.f. Table 4 |
| Buffer | c.f. Table 4 |
| Ethylenediamine tetraacetate | 1.5 g |
| Adjust pH to | 7.5 |
| with KOH, make up to 1 l with water. | |

All the fixing baths fix completely and exhibit no influence on the photographic result.

TABLE 4

(Resistance of the fixing bath to precipitation)

| Anti-oxidant (substance) mol/l | Molar ratio of fixing agent to anti-oxidant | Buffer (substance) mol/l | Precipitation | Status |
|---|---|---|---|---|
| (1) 0.1 | 10 | (3) 0.4 | severe | Comparison |
| (1) 0.2 | 5 | (3) 0.4 | severe | Comparison |
| (1) 0.4 | 2.5 | (3) 0.4 | none | Invention |
| (1) 0.4 | 2.5 | (3) 0.2 | moderate | Comparison |
| (1) 0.1 | 10 | (4) 0.4 | severe | Comparison |
| (1) 0.2 | 5 | (4) 0.4 | severe | Comparison |
| (1) 0.4 | 2.5 | (4) 0.4 | none | Invention |
| (1) 0.4 | 2.5 | (4) 0.2 | moderate | Comparison |
| (2) 0.1 | 10 | (3) 0.4 | severe | Comparison |
| (2) 0.2 | 5 | (3) 0.4 | severe | Comparison |
| (2) 0.4 | 2.5 | (3) 0.4 | none | Invention |
| (2) 0.4 | 2.5 | (3) 0.2 | moderate | Comparison |

We claim:

1. A process for the production of a color photographic image in a continuous process comprising at least the stages a) treatment with a bleaching bath containing $H_2O_2$ or a bleaching bath containing a compound which liberates $H_2O_2$ and b) fixing, wherein stage b) immediately follows stage a), and during the continuous process, a molar ratio of anti-oxidant to fixing agent of >0.2 is maintained and the fixing bath contains a buffer substance in a quantity of >0 4 mol/l.

2. The process according to claim 1, wherein the molar ratio of antioxidant to fixing agent is >0.25 and the buffer substance is present in a quantity of >0.6 mol/l.

3. The process as claimed in claim 2, wherein the anti-oxidant is sulphite or sulphinate.

4. The process as claimed in claim 1, wherein the fixing agent is thiosulphate, halide or thiocyanate.

5. The process as claimed in claim 3, wherein the fixing agent is alkali metal thiosulphate or ammonium thiosulphate.

6. The process as claimed in claim 2, wherein the buffering substance buffers at a pH value from 5 to 9.

7. The process as claimed in claim 6, wherein the buffering substance is mono-carbocyclic acid, polycarbocyclic acid, carbonate, phosphonate or phosphate.

8. The process as claimed in claim 1, wherein the process is used with low silver materials having a silver halide application rate of <0.5 g/m$^2$ (as Ag) and an AgCl content of the emulsion of greater than 95 mol. %.

* * * * *